US005320049A

United States Patent [19]

Rowland

[11] Patent Number: 5,320,049

[45] Date of Patent: Jun. 14, 1994

[54] TUBULAR PEDESTAL ASSEMBLY

[76] Inventor: David Rowland, 315 E. 91st St., New York, N.Y. 10128

[21] Appl. No.: 339,405

[22] Filed: Apr. 17, 1989

[51] Int. Cl.[5] ..... A47B 13/02

[52] U.S. Cl. ..... 108/150; 108/153

[58] Field of Search ..... 108/150, 153; 248/158, 248/188.7, 188.8, 188.9

[56] References Cited

U.S. PATENT DOCUMENTS

| | | | |
|---|---|---|---|
| D. 159,609 | 8/1950 | Goldberg . | |
| D. 164,365 | 8/1951 | Hiebert . | |
| D. 165,139 | 11/1951 | Duer . | |
| D. 203,119 | 12/1965 | Ginat . | |
| D. 208,466 | 9/1967 | Rodrigo . | |
| D. 219,661 | 1/1971 | Leidig . | |
| D. 224,876 | 10/1972 | Acton . | |
| D. 279,634 | 1/1985 | Platner . | |
| D. 284,918 | 8/1986 | McBride . | |
| 1,694,617 | 12/1928 | Brown . | |
| 1,788,133 | 1/1931 | Travers . | |
| 2,467,080 | 4/1949 | Duer . | |
| 2,812,614 | 11/1957 | Ladyman | 248/188.9 |
| 3,055,721 | 9/1962 | Holt | 108/150 X |
| 3,164,347 | 1/1965 | McMasters . | |
| 3,366,079 | 1/1968 | Koransky et al. . | |
| 3,622,980 | 5/1972 | Kantor et al. . | |
| 3,990,663 | 11/1976 | Hendrickson et al. . | |
| 4,169,625 | 10/1979 | Petersen . | |
| 4,327,461 | 5/1982 | Wisniewski | 248/188.9 X |
| 4,825,781 | 5/1989 | Palmer | 108/150 X |
| 4,979,786 | 12/1990 | Kuraseko | 248/188.9 X |

FOREIGN PATENT DOCUMENTS

| | | | |
|---|---|---|---|
| 945828 | 5/1949 | France | 108/150 |

*Primary Examiner*—Jose V. Chen

*Attorney, Agent, or Firm*—Varnum, Riddering, Schmidt & Howlett

[57] ABSTRACT

A pedestal for supporting a table top or the like wherein the pedestal includes at least two C-shaped legs. There is a tubular base for receiving base portions of the C-shaped legs with the base construction including projecting arms in accordance with the desired positions of the base portions of the legs. Each base unit is in the form of a pair of adjacent parallel arms spaced apart for receiving a base portion of an associated C-shaped leg therebetween. Outer ends of the arms are connected together by an integral bight. The arms are also connected together by straps or plates on which the lower portions of the legs are seated. There is a glide assembly which includes a fastener which secures a leg to a respective base unit. The fastener has an enlarged externally threaded head on which a glide member is threadedly engaged for vertical adjustment. Upstanding portions of a pair of legs are connected together by a generally X-shaped connector.

15 Claims, 2 Drawing Sheets

TUBULAR PEDESTAL ASSEMBLY

This invention relates in general to new and useful improvements in pedestal construction, and more particularly to a tubular pedestal assembly which may be utilized to support a table top or like structure.

The pedestal assembly includes at least two generally C-shaped legs with each leg including a base portion, an upstanding portion and a top portion extending from the upstanding portion. Such C-shaped legs per se are well known in the furniture art and particular attention is directed to prior patents showing such features. These prior patents include McMasters U.S. Pat. No. 3,164,347, Hendrickson et al U.S. Pat. No. 3,990,663, Petersen U.S. Pat. No. 4,169,625, Hiebert Des. 164,635, Platner Des. 279,634 and Ginat Des. 203,119.

The pedestal in accordance with this invention includes a base unit in the form of a plurality of interconnected U-shaped base elements which receive the base portions of the C-shaped legs.

Another feature of the invention is the interconnecting of legs wherein upper parts of the upstanding portion of each pair of legs are joined together by a generally X-shaped connecting unit with each connecting unit including a C-shaped connector carried by each of the legs and a pair of C-shaped connecting elements being connected together in spaced relation by a strap. When there are more than two pairs of legs connected together, the straps are vertically offset so that the straps do not interfere with the joining of the pairs of legs.

A particular feature of the invention is that the number of legs in each pedestal assembly may be varied. For example, there may be a two-leg pedestal, a three-leg pedestal, a four-leg pedestal or a six-leg pedestal.

It will be recognized that the various components which comprise a pedestal according to the invention may be shipped and stored disassembled in substantially flat containers.

With the above and other objects in view that will hereinafter appear, the nature of the invention will be more clearly understood by reference to the following detailed description, the appended claims, and the several views illustrated in the drawings.

Figure 1:
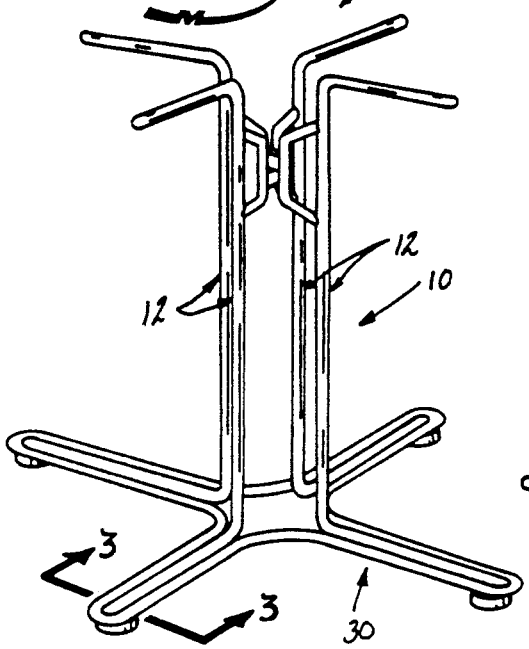
FIG. 1 is a top perspective view of a pedestal formed in accordance with this invention with the pedestal having four legs disposed at right angles to one another.

Referring now to the drawings in detail, there is illustrated in FIG. 1 a typical pedestal construction formed in accordance with this invention, the pedestal being generally identified by the numeral 10. In the illustrated embodiment, the pedestal 10 includes four legs 12 with the legs 12 being identical and joined together in pairs as will be described in detail hereinafter.

Figure 2:
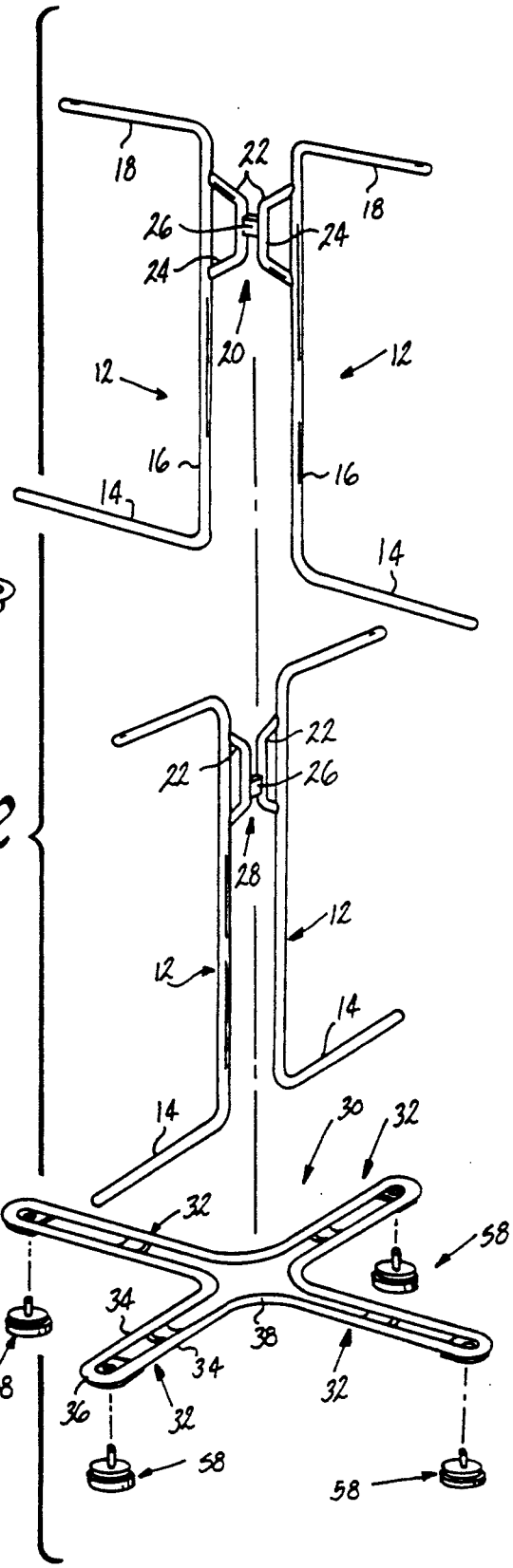
FIG. 2 is an exploded perspective view showing the pedestal of FIG. 1 with the various parts thereof disassembled.

Referring now to FIG. 2 in particular, it will be seen that each leg 12 includes a base portion 14, an upstanding portion 16 and an upper portion 18 with the upper portion 18 being preferably parallel to the base portion 14.

Each pair of legs 12 are joined together along upper parts of the upstanding portion 16 thereof by a connector unit generally identified by the numeral 20. Each connector unit 20 is generally of an X-shaped configuration and is formed by a pair of generally C-shaped connectors 22 which are arranged in back-to-back relation. The legs 12 are preferably formed of tubing as are the C-shaped connectors 22. Each C-shaped connector 22 has free ends which project into an associated upstanding portion 16 of a related leg 12 and is suitably secured thereto either by metal deformation or welding.

Each C-shaped connector 22 has an upstanding portion 24 with the upstanding portions 24 of a pair of C-shaped connectors 22 being disposed in spaced parallel relation and preferably joined together by a connecting strap 26. The connecting strap 26 preferably has the ends thereof which extend into the C-shaped connectors and are secured thereto either by metal deformation or welding.

In the illustrated embodiment where there are four legs 12, the legs of the second set of legs are joined together by a connector generally identified by the numeral 28. The connector 28 is substantially identical to the connector 20 except for the placement of its strap 26. It will be seen that the strap 26 of the connector 28 extends between lower parts of the upstanding portions 24 of the C-shaped connectors 22, while in the connector 20 the strap 26 extends between upper parts of the upstanding portions 24. Thus, as is clearly shown in FIG. 1, the legs 12 connected together by the connector 20 may be dropped into interlocked relation with respect to the legs 12 connected together by the connector 28 without the straps 26 interfering with one another.

Figure 3:
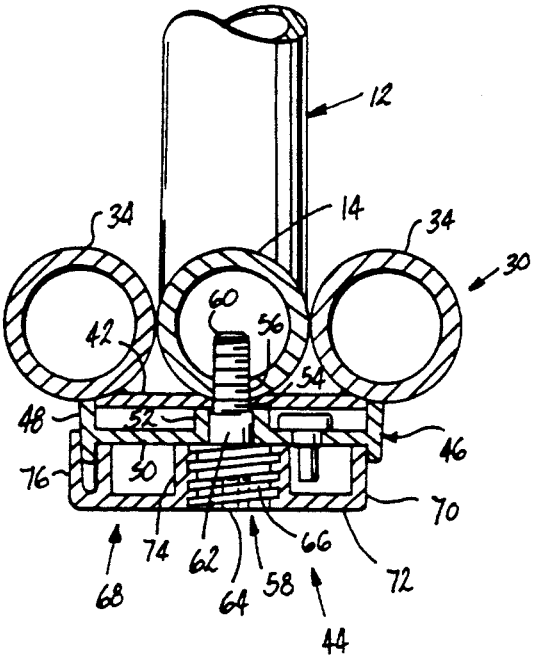
FIG. 3 is an enlarged fragmentary vertical sectional view taken generally along the line 3—3 of FIG. 1 and shows the specific mounting of a pedestal leg in its associated base unit utilizing an associated glide.

Another particular feature of the invention is the formation of a base unit, generally identified by the numeral 30, for receiving the lower portions 14 of the legs 12. Like the legs 12, the base unit 30 is formed of tubing and is defined by a plurality of U-shaped base elements which are interconnected and which are configured to receive base portions 14 of respective legs 12. Each U-shaped base element 32 is formed of a pair of arms 34 disposed in spaced parallel relation with the spacing between parallel arms 34 being in accordance with the size of the tubing from which the base portion 14 of an associated leg 12 is formed, as is best shown in FIG. 3.

The end of each U-shaped base element 32 is defined by a U-bend or bight portion 36 formed integral with and interconnecting the pair of arms 34 at their outer ends. Inner ends of the arms 34 are also integrally interconnected. When there are three or more of the U-shaped base elements 32, then arms of adjacent U-shaped base elements 32 will be connected by arcuate bends 38.

It is pointed out that if there is only one pair of legs 12, the arms 34 of adjacent U-shaped base elements will be straight continuations of one another and there will be no bends 38. On the other hand, should the angle between two pairs of legs 12 be other than 90 degrees, the base elements 32 will be in the same angular relation to one another.

Figure 7:
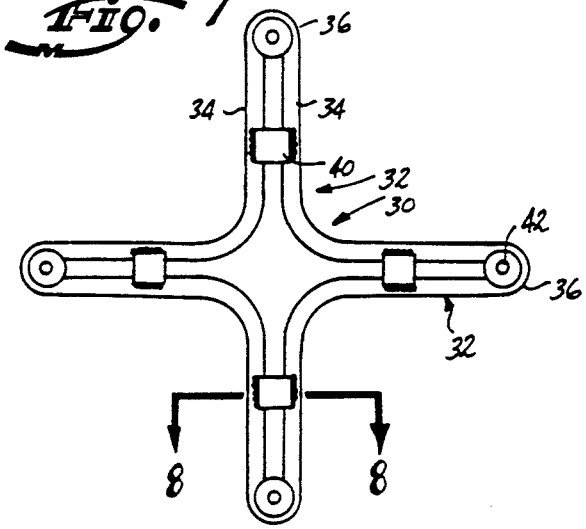
FIG. 7 is a plan view of the base unit per se.
Figure 8:
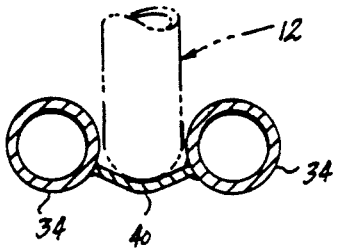
FIG. 8 is an enlarged fragmentary transverse vertical sectional view taken generally along the line 8—8 of FIG. 7 and shows the manner in which arms of a base unit are connected together by a strap forming a seat for a leg base portion.

Referring now to FIG. 7 which shows the base 30 from the underside thereof, it will be seen that the legs 34 of each U-shaped base element 32 are connected together remote from the bight 36 by straps 40 which extend between the arms 34 and are preferably secured to the arms 34 by welding. As is best shown in FIG. 8, each strap 40 is of a concave configuration so as to define a seat for a respective base portion of an associated leg 12.

Further, it will be seen that the arms 34 of each U-shaped base element 32 have suitably secured to the undersides thereof, as by welding, a circular connecting plate 42 which also partially overlies the associated bight portion 36. The function of the plate 42 is best shown in FIG. 3. It will be seen that the circular plate 42 is flush with the underside of the arms 34 and may have seated thereon a respective base portion 14.

A glide assembly, generally identified by the numeral 44, is also associated with the circular plate 42 and is utilized in part to releasably secure an associated leg 12 to the base unit 30. First of all, the glide assembly 44 includes a support member 46 having a generally cylindrical rim portion 48 which carries an internal plate 50 intermediate its ends. The plate 50, in turn, has a boss 52.

The plate 42 has an opening 54 therethrough in alignment with a threaded opening 56 in the bottom of a respective base portion 14. These openings are in alignment with the boss 52. A special fastener, generally identified by the numeral 58 is utilized to secure the support member 46 to the underside of the base 30 and to clamp the base portion 14 of an associated leg 12 to the plate 42. The fastener 58 includes a threaded shank portion 60 which is threaded through the opening 56 and a threadless shank portion 62 which is received in the boss 52. Finally, the fastener 58 includes an enlarged head 64 which engages the plate 50 to clamp the support member 46 against the base 30. The head 64 is provided with course external threads 66.

The glide assembly 44 further includes a glide member generally identified by the numeral 68. The glide member 68 is generally cup-shaped and includes a cylindrical upper portion 70 and a base plate 72. The base plate 72, in turn, carries an internally threaded boss 74 which threads onto the fastener head 64 so as to permit vertical adjustment of the glide member 68.

It is to be noted that the cylindrical portion 70 of the glide member 68 is of an external diameter to fit within the cylindrical part 48 of the support member 46. The glide 68 also carries an outer finger 76 which frictionally engages the exterior of the cylindrical portion 48 to generally prevent relative rotation between the glide member 68 and the fastener head 64 to thus maintain the glide member 68 in a vertically adjusted position.

Figure 4:
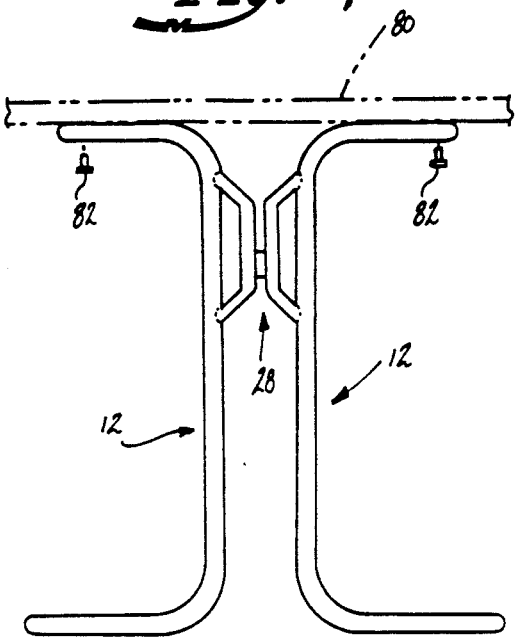
FIG. 4 is an elevational view showing the manner in which a table top, for example, may be secured to a pair of legs.
Figure 5:
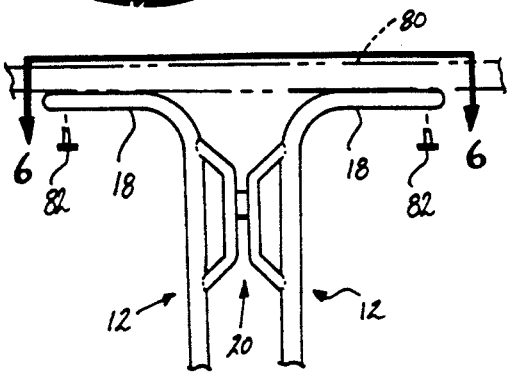
FIG. 5 is a fragmentary elevational view showing a second pair of legs of the pedestal and the manner in which they may be secured to the table top.
Figure 6:
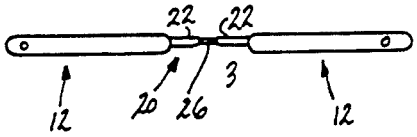
FIG. 6 is a horizontal sectional view taken generally along the line 6—6 of FIG. 5 and shows the details of the connector between legs of a pair of legs.

Referring now to FIGS. 4–6, a table top or like top, shown in phantom lines and identified by the numeral 80, may be secured to the upper portions 18 of the legs 12 in any suitable manner. For purposes of illustration, there are provided screws 82 which may pass through the upper portions 18 and thread into the underside of the table top 80.

It is feasible for the leg assembly shown in FIG. 5 to be utilized in its foreshortened configuration. Such a foreshortened leg assembly as shown in FIG. 5 may be utilized in combination with the leg assembly shown in FIG. 4 wherein the connector assembly 20 will interlock with the connector assembly 28 and hold the foreshortened leg assembly in position with respect to the full height leg assembly to provide for a full supporting of a table top or the like against tilting.

Although only a preferred embodiment of the pedestal has been specifically illustrated and described herein it is to be understood that minor variations may be made in the pedestal without departing from the spirit and scope of the invention as defined by the appended claims.

I claim:

1. A pedestal for a table and the like, said pedestal comprising two pairs of legs, each of said legs including an upstanding portion and a base portion, said upstanding portion having attaching means for attaching said legs to a top member of a table and the like, a connector carried by each upstanding leg portion, and a strap extending between the connectors of opposing pairs of said legs and connecting together the connectors, the upstanding leg portions being spaced apart a predetermined distance such that the respective pairs of legs can be interlocked by placing the connector of one pair of legs above the connector of the other pair of said legs with the upstanding portion of the legs of said one pair of legs on opposite sides of the upstanding portion of the other pair of said legs, and a base unit receiving said base portions, said base unit including a plurality of interconnected U-shaped base elements receiving said base portions, and mounting means carried by said base elements releasably securing each base portion to a respective one of said base elements.

2. A pedestal according to claim 1 wherein said attaching means includes a top portion extending from said upstanding portion generally parallel to and in overlying alignment with said base portion with each of said legs being C-shaped in elevation.

3. A pedestal according to claim 1 wherein each base element includes two spaced parallel arms connected together at outer ends, the spacing between said two arms being generally equal to a transverse width of an associated one of said base portions in plan, and each pair of arms have outer ends joined by a U-bend, the associated one of said base portions is received within the spacing between the spaced parallel arms of each base element.

4. A pedestal according to claim 1 wherein said connecting means includes a C-shaped member carried by each upstanding leg portion, said C-shaped members having vertical portions in back-to-back spaced relation, and strap means extending between said C-shaped member vertical portions and connecting together two cooperating C-shaped members in said spaced relation.

5. A pedestal according to claim 4 wherein each of said C-shaped members have ends extending into and secured to a respective leg upstanding portion.

6. A pedestal according to claim 4 wherein said strap means includes one strap carried by each pair of C-shaped members, and each of said straps having a portion extending into and secured to a respective one of said C-shaped members.

7. A pedestal for a table and the like, said pedestal comprising at least two legs, each of said legs including an upstanding portion and a base portion, said upstanding portion having attaching means for attaching said legs to a top member of a table and the like, connecting means connecting together upper parts of said upstanding portions, and a base unit receiving said base portions, each base unit includes a plurality of base elements comprising two spaced parallel arms connected together at outer ends, the spacing between said two arms being generally equal to a transverse width of an associated one of said base portions in plan, said base portion received by the associated base element in the spacing between the two parallel arms, and mounting means carried by said spaced parallel arms releasably securing each base portion to the associated one of said base elements.

8. A pedestal according to claim 7 wherein said legs and said base are formed of tubing.

9. A pedestal according to claim 7 wherein said legs and said base are formed of tubing of like size.

10. A pedestal according to claim 7 wherein adjacent base units are continuations of one another.

11. A pedestal according to claim 7 wherein said legs and said base are formed of tubing, and each pair of arms have outer ends joined by a U-bend.

12. A pedestal according to claim 11 wherein adjacent base units are continuations of one another.

13. A pedestal according to claim 7 wherein outer portions of each pair of arms are joined together by an underlying strap, a respective leg base portion being seated on said strap, and a glide being carried by said strap and being secured to said leg base portion by a fastener clamping said leg base portion to said strap.

14. A pedestal according to claim 13 wherein said fastener has an enlarged head underlying said strap, and a shank extending through said strap and being threaded into said leg base portion, said enlarged head being externally threaded, and said glide including a glide base having a central portion threaded onto said head for vertical adjustment.

15. A pedestal according to claim 14 wherein said glide base is of a cup-shaped configuration for sliding engagement with a supporting surface.

* * * * *